US009648428B2

(12) United States Patent
Lee et al.

(10) Patent No.: US 9,648,428 B2
(45) Date of Patent: May 9, 2017

(54) WIRELESS COMMUNICATION METHOD AND APPARATUS OF HEARING DEVICE

(71) Applicant: Samsung Electronics Co., Ltd., Suwon-si (KR)

(72) Inventors: Heun Chul Lee, Pocheon-si (KR); Yun Seo Ku, Seoul (KR); Dong Wook Kim, Seoul (KR); Jong Jin Kim, Hwaseong-si (KR); Jun Il Sohn, Yongin-si (KR); Jun Whon Uhm, Anyang-si (KR); Jong Min Choi, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 569 days.

(21) Appl. No.: 14/092,805

(22) Filed: Nov. 27, 2013

(65) Prior Publication Data

US 2014/0146988 A1 May 29, 2014

(30) Foreign Application Priority Data

Nov. 27, 2012 (KR) ..... 10-2012-0135130

(51) Int. Cl.
*H04R 25/00* (2006.01)

(52) U.S. Cl.
CPC ..... *H04R 25/554* (2013.01); *H04R 25/407* (2013.01); *H04R 25/552* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,345,599 | A | 9/1994 | Paulraj et al. | |
| 7,397,926 | B1 | 7/2008 | Frerking | |
| 2003/0122713 | A1 | 7/2003 | Morris et al. | |
| 2005/0280744 | A1 * | 12/2005 | Shin | H04N 21/485 348/738 |
| 2009/0046879 | A1 | 2/2009 | Knudsen et al. | |
| 2009/0239565 | A1 * | 9/2009 | Han | H04B 7/0404 455/512 |
| 2010/0104036 | A1 * | 4/2010 | Liao | H04L 1/0072 375/260 |
| 2010/0195836 | A1 * | 8/2010 | Platz | G09B 21/006 381/26 |

(Continued)

FOREIGN PATENT DOCUMENTS

| | | | | |
|---|---|---|---|---|
| FI | WO 2013117964 A1 * | 8/2013 | | G01S 11/14 |
| JP | 2003-163999 A | 6/2003 | | |

(Continued)

*Primary Examiner* — Duc Nguyen
*Assistant Examiner* — Assad Mohammed
(74) *Attorney, Agent, or Firm* — NSIP Law

(57) ABSTRACT

A wireless communication method of a hearing aid includes extracting an audio signal through a first hearing aid, determining a beam forming vector as a beam toward a rear of a user wearing the first hearing aid and a second hearing aid. The method may also include pre-coding of the audio signal using the beam forming vector, and transmitting the pre-coded audio signal to the second hearing aid through a first antenna. The first hearing aid may include the first antenna and the second hearing aid includes a second antenna.

13 Claims, 10 Drawing Sheets

(56) References Cited

U.S. PATENT DOCUMENTS

| | | | | |
|---|---|---|---|---|
| 2011/0249713 | A1* | 10/2011 | Hammarwall | H04B 7/0634 375/220 |
| 2011/0280333 | A1* | 11/2011 | Yang | H04L 5/003 375/295 |
| 2012/0008807 | A1 | 1/2012 | Gran | |
| 2013/0316642 | A1* | 11/2013 | Newham | H04W 52/0206 455/11.1 |
| 2013/0317830 | A1* | 11/2013 | Visser | G10L 19/00 704/500 |

FOREIGN PATENT DOCUMENTS

| | | | |
|---|---|---|---|
| KR | 10-0477348 | B1 | 3/2005 |
| KR | 10-2010-0087686 | A | 8/2010 |
| KR | 10-2011-0058853 | A | 6/2011 |
| KR | 10-2011-0091760 | A | 8/2011 |

* cited by examiner

WIRELESS COMMUNICATION METHOD AND APPARATUS OF HEARING DEVICE

CROSS-REFERENCE TO RELATED APPLICATION(S)

This application claims the benefit under 35 USC §119(a) of Korean Patent Application No. 10-2012-0135130, filed on Nov. 27, 2012, in the Korean Intellectual Property Office, the entire disclosure of which is incorporated herein by reference for all purposes.

BACKGROUND

1. Field

The following description relates to a wireless communication system and method for a hearing device. For example, the following description relates to a technology for wireless communication for a hearing aid device.

2. Description of Related Art

In relation to a wireless communication system for a hearing device, a wireless communication technology is technology enabling wireless communication through an antenna in the hearing device.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In accordance with an illustrative example, there is provided a wireless communication method of a hearing device, the method including extracting an audio signal through a first hearing aid; determining a beam forming vector as a beam toward a rear of a head of a user wearing the first hearing aid and a second hearing aid; pre-coding of the audio signal using the beam forming vector; and transmitting the pre-coded audio signal to the second hearing aid.

The wireless communication method may also include configuring the hearing device to include the first hearing aid and the second hearing aid and configuring the first hearing aid to include a first antenna and the second hearing aid includes a second antenna.

The wireless communication method may also include measuring the audio signal through a wireless channel between the first antenna mounted on the first hearing aid and the second antenna mounted on the second hearing aid. The determining of the beam forming vector may include determining the beam forming vector based on the measured audio signal through the wireless channel.

The wireless communication method may further include determining a direction of the beam forming vector from the audio signal through the wireless channel measured between the first antenna mounted at the first hearing aid and the second antenna mounted to the second hearing aid.

The determining of the beam forming vector may include selecting a preset beam forming vector as a fixed value.

The wireless communication method may further include receiving the pre-coded audio signal through the second antenna; performing combining of the pre-coded audio signal at the second hearing aid; and extracting a desired audio signal from a result of the combining.

The performing of the combining of the pre-coded audio signal may include determining a received combined vector based on the wireless channel.

The wireless communication method may further include receiving at least two audio signals spatially multiplexed by an audio source; and selecting one of the at least two spatial-multiplexed audio signals.

The wireless communication method may further include selecting the first hearing aid as a transmitting hearing aid and selecting the second hearing aid as a receiving hearing aid based on a preset setting.

The wireless communication method may also include controlling a physical direction of the first antenna or the second antenna.

The wireless communication method may include measuring in real time the audio signals through the wireless channel between the first antenna of the first hearing aid and the second antenna of the second hearing aid.

In accordance with another illustrative example, there is provided a method for wireless communication between a hearing device and an external device. The method includes measuring audio signals from a first wireless channel between the external device and a first hearing aid and from a second wireless channel between the external device and a second hearing aid; determining a first received combined vector corresponding to the first hearing aid and a second received combined vector corresponding to the second hearing aid from the audio signals of the first wireless channel and the second wireless channel; and combining the first received combined vector and the second received combined vector based on an audio signal pre-coded by the external device.

The first hearing aid may include a first multiple antenna and the second hearing aid may include a second multiple antenna.

The determining of the first received combined vector corresponding to the first hearing aid and the second received combined vector corresponding to the second hearing aid may include determining the first received combined vector corresponding to the first hearing aid and the second received combined vector corresponding to the second hearing aid so that a reception beam is formed toward a front of a user wearing the first hearing aid and the second hearing aid.

The method may also include receiving at least two audio signals spatially multiplexed by the external device; and selecting any one from the at least two spatial-multiplexed audio signals.

In accordance with an example, there is provided a wireless communication method between a hearing device and an external device, the method includes selecting a target communication mode from a first communication mode between the hearing device and the external device and a second communication mode between a first hearing aid of the hearing device and a second hearing aid of the hearing device; and determining a beam forming vector or a received combined vector corresponding to the first hearing aid and the second hearing aid in the selected target communication mode to perform signal processing.

The method may further include determining a first received combined vector corresponding to the first hearing aid and a second received combined vector corresponding to the second hearing aid, based on audio signals through a first wireless channel between the external device and the first hearing aid and audio signals through a second wireless channel between the external device and the second hearing aid, when the second communication mode is selected as the target communication mode; and performing signal processing using the first received combined vector and the second received combined vector.

The method may also include determining a beam forming vector to form a beam toward a rear of a user wearing the first hearing aid and the second hearing aid, and a received combined vector when the second communication mode is selected as the target communication mode; and performing signal processing using the beam forming vector and the received combined vector.

In accordance with an illustrative example, there is provided a hearing device including a communication module configured to determine a beam forming vector to form a beam toward a rear of a user wearing a first hearing aid and a second hearing aid and to pre-code the audio signal using the beam forming vector; and a first antenna of the first hearing aid configured to transmit the pre-coded audio signal to the second hearing aid.

The first hearing aid further may include a processor configured to process the pre-coded audio signal; and a speaker configured to output the processed audio signal.

The second hearing aid may include a second antenna configured to receive the pre-coded audio signal from the first hearing aid; a communication module configured to determine a received combined vector based on an audio signal through a wireless channel and perform combining of the pre-coded audio signal using the received combined vector; a processor configured to process the combined audio signal; and a speaker configured to output the processed audio signal.

The first antenna may include multiple first antennas and the second antenna may include multiple second antennas.

Other features and aspects will be apparent from the following detailed description, the drawings, and the claims.

Figure 1:
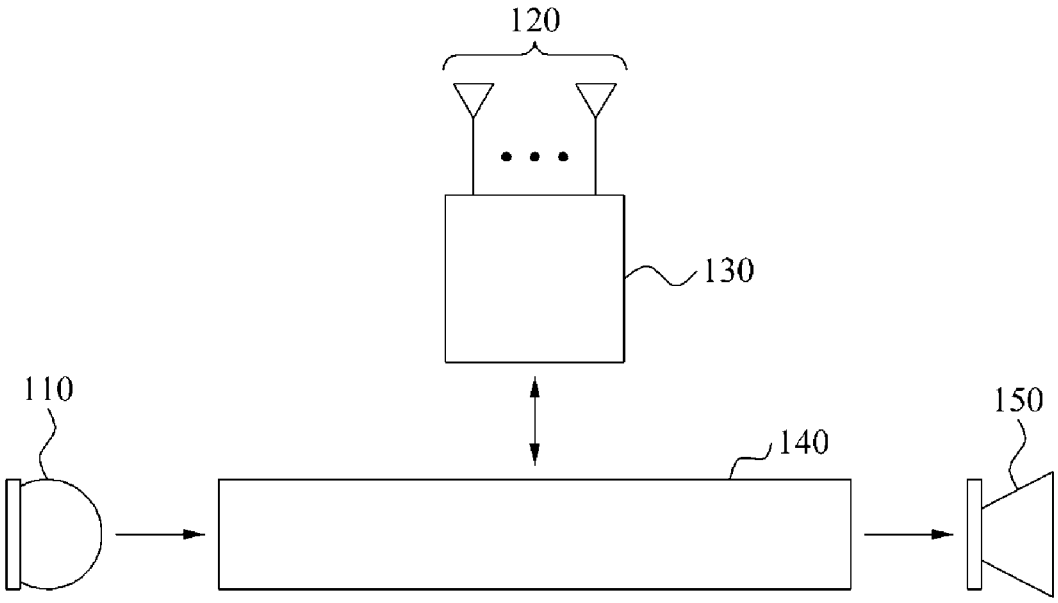
FIG. 1 is a diagram illustrating an example of a hearing device, in accordance with an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses, and/or methods described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, description of well-known functions and constructions may be omitted for increased clarity and conciseness.

FIG. 1 illustrates an example of a hearing device, in accordance with an embodiment.

Referring to FIG. 1, the hearing device includes a microphone 110 configured to receive audio signals, at least one antenna 120 configured to transmit and receive pre-coded audio signals, a processor 140 configured to process the audio signals, a speaker 150 configured to output the processed audio signals, and a communication module 130.

The hearing device may be a binaural hearing device (dual hearing aids or two hearing aids). The binaural hearing device may include a first hearing aid and a second hearing aid, each including the microphone 110, the at least one antenna 120, the processor 140, the speaker 150, and the communication module 130.

The antenna 120 may apply a multiple input multiple output (MIMO) scheme to the received audio signals.

The processor 140 may include an analog/digital (A/D) converter that converts an analog signal into a digital signal, a D/A converter converter that converts a digital signal into an analog signal, and a digital signal processor (DSP).

In one illustrative example, the communication module 130 is configured to measure audio signals transmitted and received through a wireless channel between the antennas 120, which are disposed at both sides of the binaural hearing device, and determine a beam forming vector and a received combined vector based on the measured audio signals through the wireless channel. In addition, the communication module 130 is configured to perform pre-coding of the audio signals using the beam forming vector, and perform a combination of the pre-coded audio signals to determine the received combined vector.

Furthermore, the communication module 130 is configured to measure the audio signals received and transmitted through a wireless channel between the binaural hearing device and the external wireless device, respectively, and determine received combined vectors from both sides of the binaural hearing device, based on the audio signals received and transmitted through the wireless channel. In addition, the communication module 130 may perform a combination of the audio signals using the received combined vectors.

In one example, the wireless channel between the multiple antennas of the binaural hearing device and the wireless channel between the binaural hearing device and the external wireless device may be measured taking into account interferences including from a head of the user and from external environments. A head 210 of the user may be an interference because the head can absorb communication signals in a wireless communication environment of the binaural hearing device. The interferences from the external environments include continuous noises, transient noises, and wind noises.

Figure 2:
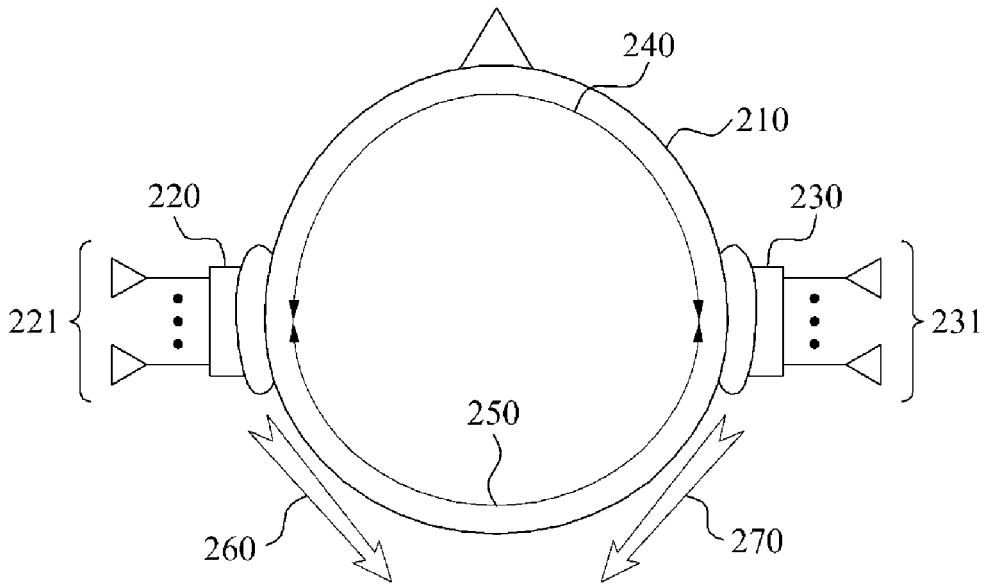
FIG. 2 is a diagram illustrating an example of wireless communication of the hearing device, in accordance with an embodiment.

FIG. 2 illustrates an example of wireless communication of the hearing device, in accordance with an embodiment.

Referring to FIG. 2, the wireless communication includes a user of a binaural hearing device, and the binaural hearing device including hearing aids 220 and 230 which include at least one antenna 221 and 231, respectively.

In this example, the head 210 of the user may interfere between the hearing aids 220 and 230. The head 210 may affect or be influential to determine beam forming vectors 260 and 270 and received combined vectors of audio signals received and transmitted through a wireless channel measured between a first antenna 221 of the first hearing aid 220 and a second antenna 231 of the second hearing aid 230.

The beam forming vectors 260 are determined, in one example, by a communication module in the first hearing aid 220 as vectorial representations of measured audio signals that are transmitted from a wireless channel at the first antenna 221 to the second antenna 231. The beam forming vectors 270 are determined, in one example, by a communication module in the second hearing aid 230 as vectorial representations of measured audio signals that are transmitted from a wireless channel at the second antenna 231 to the first antenna 221. The received combined vectors are determined, in an example, by the communication modules in the first hearing aid 220 and the second hearing aid 230 as vectorial representations of pre-coded vectorial audio signals between the first antenna 221 and the second antenna 231.

In one example, a front portion 240 of the head 210 is longer than a rear portion 250 of the head 210. Therefore, to optimize the strength and reliability of the beam forming vectors 260 and 270, the beam forming vectors 260 and 270 may be directed to the rear portion 250 of the head 210 which is shorter than the front portion 240 in the head 210 and formed parallel with the head 210.

In one example, the front portion 240 of the head 210 may be set to be in a range of about 180 degrees toward a front of the user, based on an imaginary line with reference to an ear of the user. The rear portion 250 may be set to be in a range of about 180 degrees toward a rear of the user, based on the imaginary line with reference to the ear of the user. However, the ranges of the front portion 240 and the rear portion 250 may be reduced or increased.

The binaural hearing device may transmit and receive audio signals being pre-coded or combined, using the beam forming vectors 260 and 270 and the received combined vectors corresponding to the audio signals transmitted and received through the wireless channel measured between the first antenna 221 of the first hearing aid 220 and the second antenna 231 of the second hearing aid 230. Also, the pre-coding and combining may be performed at the communication modules in the first hearing aid 220 and the second hearing aid 230 or at one of the communication modules in the first hearing aid 220 and the second hearing aid 230. In one instance, physical directions of the first antenna 221 and the second antenna 231 may be controlled. Also, the first antenna 221 and the second antenna 231 may be made of a metamaterial.

The first hearing aid 220 may be a left hearing aid or a right hearing aid of the binaural hearing device and may be configured as a transmitting hearing device functioning as a transmitting hearing aid. The second hearing aid 230 may be the left or the right hearing aid of the binaural hearing device and may be configured as a receiving hearing device functioning as a receiving hearing aid.

Wireless communication methods at the first hearing aid 220 and the second hearing aid 230 will be described in detail with reference to FIGS. 3 and 4, respectively.

Figure 3:
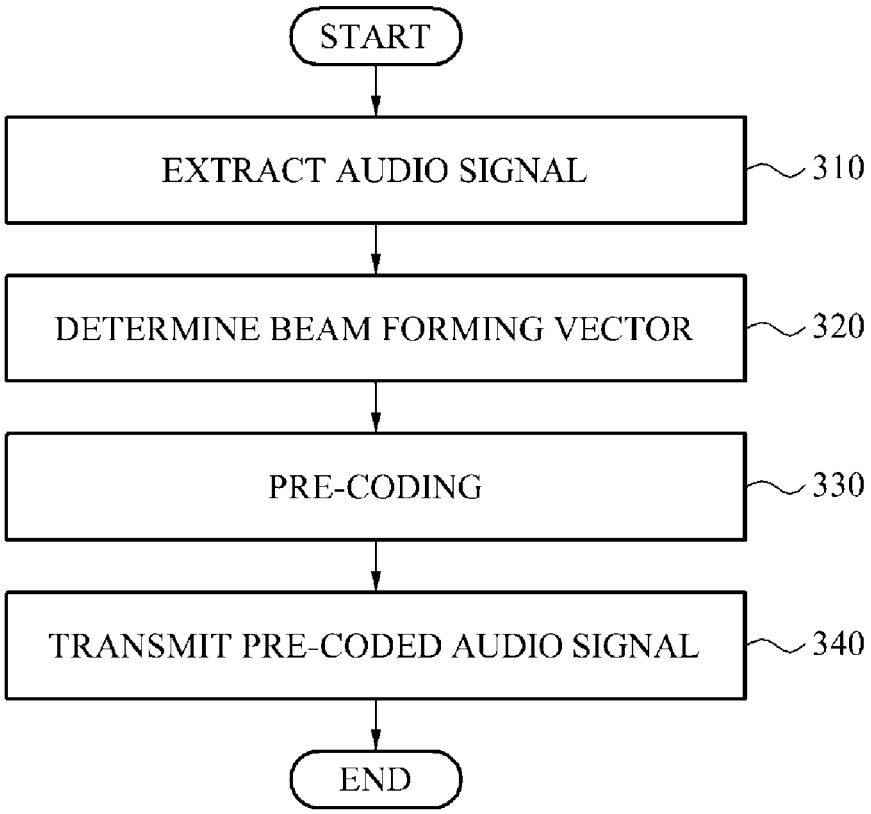
FIG. 3 is a flowchart illustrating an example of a wireless communication method of a transmitting hearing device, in accordance with an embodiment.

FIG. 3 illustrates an example of a wireless communication method of a transmitting hearing device, in accordance with an embodiment.

Referring to FIG. 3, at operation 310, the method extracts an audio signal from the first hearing aid 220.

At operation 320, the method determines a beam forming vector 260 at the first hearing aid 220 as a beam directed to a rear of a user wearing the first hearing aid 220 and the second hearing aid 230. In one example, a direction of the beam forming vector 260 is determined from audio signals through the wireless channel measured between the first antenna 221 mounted at the first hearing aid 220 and the second antenna 231 mounted to the second hearing aid 230. The wireless channel between the first antenna 221 of the first hearing aid 220 and the second antenna 231 of the second hearing aid 230 may be measured in real time. The beam forming vector may be selected at a preset fixed direction. As will be described hereinafter, the direction of the beam forming vector 260 may be determined in advance for a binaural hearing device of a unilateral hearing loss patient.

At operation 330, at the first hearing aid 220, the method performs a pre-coding of an audio signal using the beam forming vector 260.

Additionally, the method transmits the pre-coded audio signal from the first hearing aid 220 to the second hearing aid 230 through the first antenna 221.

Figure 4:
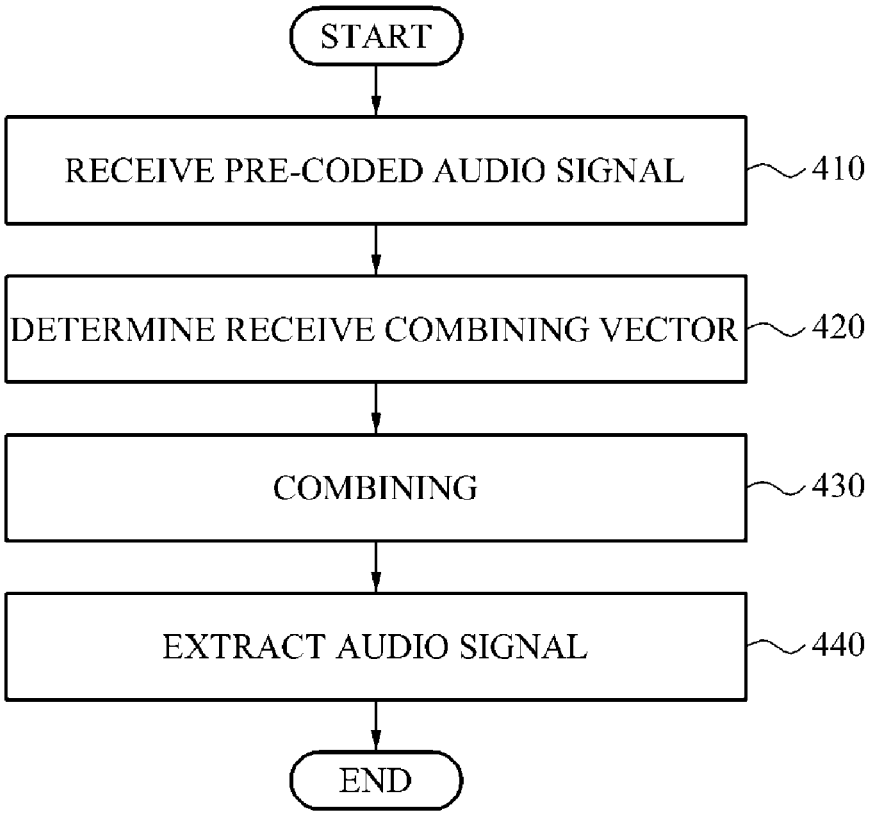
FIG. 4 is a flowchart illustrating an example of a wireless communication method of a receiving hearing device, in accordance with an embodiment.

FIG. 4 illustrates an example of a wireless communication method of a receiving hearing device, in accordance with an embodiment. In this example, the user is wearing the first hearing aid 220 and the second hearing aid 230.

Referring to FIG. 4, at operation 410, the method receives a pre-coded audio signal at the second antenna 231 of the second hearing aid 230.

At operation 420, the method determines a received combined vector toward a rear of the user's head at the second hearing aid 230. In one example, the method determines a direction of the received combined vector based on audio signals from a wireless channel measured between the first antenna 221 mounted on the first hearing aid 220 and the second antenna 231 mounted on the second hearing aid 230. The method may measure in real time the wireless channel between the first antenna 221 of the first hearing aid 220 and the second antenna 231 of the second hearing aid 230. The method may select received combined vector at a preset fixed direction. As will be described hereinafter, in case of a binaural hearing device for a unilateral hearing loss patient, the method may determine in advance the direction of the beam forming vector.

In operation 430, the method combining the audio signals at the second hearing aid 230 using the received combined vector.

In operation 440, the method extracts at the second hearing aid 230 a desired audio signal from a result of the performed combination.

Figure 5:
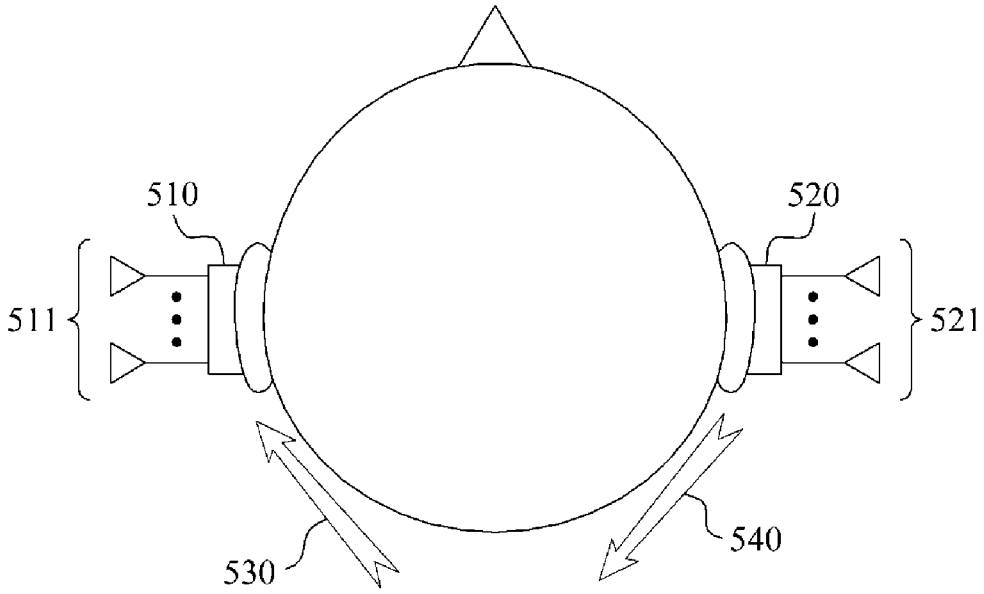
FIG. 5 is a diagram illustrating an example of wireless communication of a hearing device based on preset setting, in accordance with an embodiment.

FIG. 5 is a diagram illustrating an example of wireless communication of a hearing device based on preset setting, in accord with an embodiment.

Referring to FIG. 5, the hearing device includes a first hearing aid 510 with a first antenna 511 mounted thereon and a second hearing aid 520 with a second antenna 521 mounted thereon.

The hearing device is configured to select the first hearing aid 510 as a transmitting hearing aid and select the second hearing aid 520 as a receiving hearing aid based on preset setting. For example, in a binaural hearing device for a unilateral hearing loss patient, the first hearing aid 510 may be selected as the transmitting hearing aid while the second hearing aid 520 may be selected as the receiving hearing aid according to the unilateral direction of the hearing loss patient. That is, an optimal beam forming vector and a received combined vector may be set according to the preset setting.

In further detail, in case in which the user has hearing loss at a right ear, the first hearing aid 510 may be selected as the receiving hearing aid while the second hearing aid 520 may be selected as the transmitting hearing aid. In one example, the second hearing aid 520 worn on the ear with hearing loss determines a beam forming vector 540 to be parallel with a head of the user and directed towards a rear of the head of the user. The first hearing aid 510 determines a received combined vector 530 to be parallel with the head of the user and directed from the rear of the head of the user towards the left ear of the user.

Figure 6:
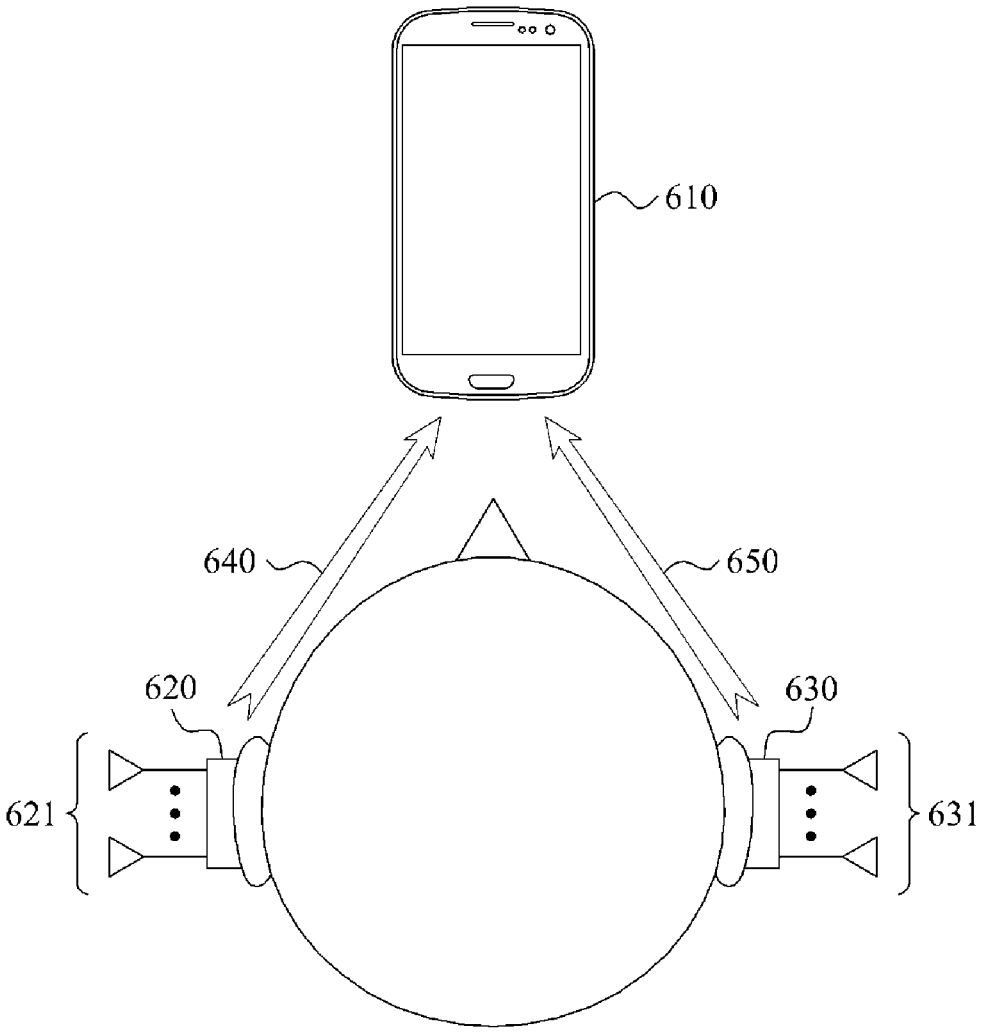
FIG. 6 is a diagram illustrating an example of wireless communication performed between the hearing device and an external wireless device, in accordance with an embodiment.

FIG. 6 is a diagram illustrating an example of wireless communication performed between the hearing device and an external wireless device, in accordance with an embodiment.

Referring to FIG. 6, the hearing device includes a first hearing aid 620 with a first antenna 621, and a second hearing aid 630 with a second antenna 631. FIG. 6 also illustrates an external wireless device 610.

A configuration of the hearing aids 620 and 630 may support wireless communication between the hearing aids 620 and 630 of a binaural hearing device. The external wireless device 610 may refer to a mobile device such as a cellular phone, a personal digital assistant (PDA), a digital camera, a portable game console, and an MP3 player, a portable/personal multimedia player (PMP), a handheld e-book, a portable lab-top PC, a global positioning system (GPS) navigation, and devices such as a desktop PC, a high definition television (HDTV), an optical disc player, a setup box, and the like capable of wireless communication or network communication consistent with that disclosed herein.

Communication between the hearing aids 620 and 630 and the external wireless device 610 may be performed based on a first received combined vector 640 and a second received combined vector 650. The first received combined vector 640 is determined by measuring audio signals through a first wireless channel between the external wireless device 610 and the first antenna 621 of the first hearing aid 620 and obtaining a vectorial representation of the measured audio signals. The second received combined vector 650 is determined by measuring audio signals through a second wireless channel between the external wireless device 610 and the second antenna 631 of the second hearing aid 630 and obtaining a vectorial representation of the measured audio signals. In one illustrative example, directions of the first received combined vector 640 and the second received combined vector 650 may be optimized so that a beam is formed toward the external wireless device 610, taking into consideration interference from the head of the user or external noises. Accordingly, the beam may be formed to be parallel with a surface of a head of a user and directed towards a front of the user.

Figure 7:
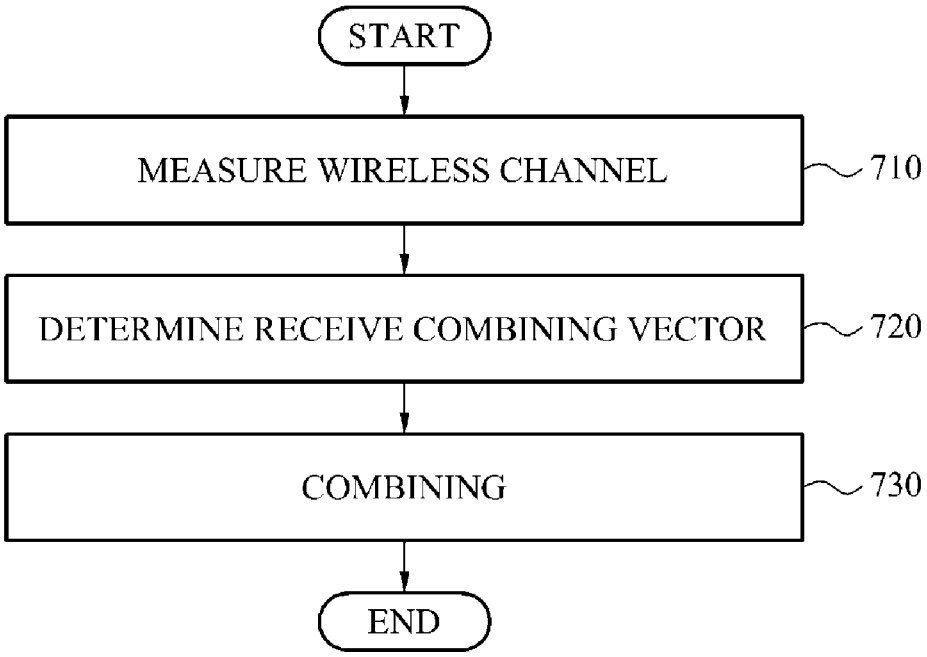
FIG. 7 is a flowchart illustrating an example of a wireless communication method between the hearing device and the external wireless device, in accordance with an embodiment.

FIG. 7 illustrates an example of a wireless communication method between the hearing device and the external wireless device, in accordance with an embodiment.

Referring to FIG. 7, at operation 710, the method measures audio signals through a first wireless channel between the external wireless device and the first hearing aid 620 and measures audio signals through a second wireless channel between the external wireless device and the second hearing aid 630. In one example, the method may measure the audio signals through the first wireless channel between the external wireless device and the first antenna 621 mounted on the first hearing aid 620. The method may also measure the audio signals through the second wireless channel between the external wireless device and the second antenna 631 mounted on the second hearing aid 630.

At operation 720, the method determines a first received combined vector corresponding to the first hearing aid 620 and a second received combined vector corresponding to the second hearing aid 630 from the audio signals measured through the first wireless channel and the second wireless channel.

At operation 730, the method combines the first received combined vector and the second received combined vector based on an audio signal pre-coded by the external wireless device.

Figure 8:
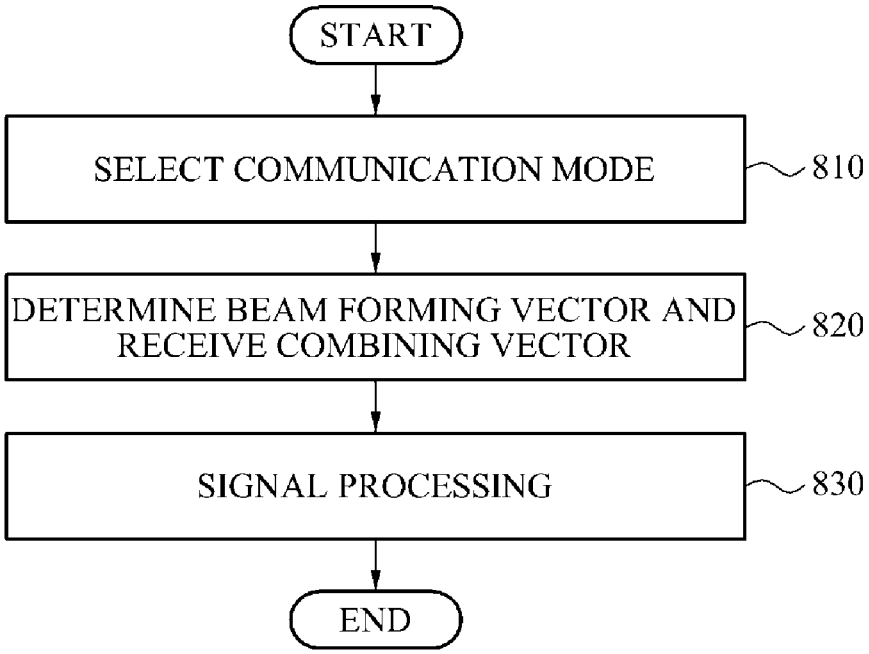
FIG. 8 is a flowchart illustrating an example of a wireless communication method of a wireless communication system that includes the hearing device and the external wireless device, in accordance with an embodiment.

FIG. 8 illustrates an example of a wireless communication method of a wireless communication system that includes the hearing device and the external wireless device, in accordance with an embodiment.

Referring to FIG. 8, at operation 810, the method selects a target communication mode from a first communication mode to perform wireless communication between the hearing device and the external wireless device. The method also selects a second communication mode to perform wireless communication between a first hearing aid and a second hearing aid.

At operation 820, in the target communication mode, the method determines a beam forming vector or a received combined vector corresponding to the first hearing aid 620 and the second hearing aid 630.

At operation 830, the method performs signal processing using the beam forming vector or the received combined vector.

For example, when the first communication mode is selected as the target communication mode, the method determines a first received combined vector corresponding to the first hearing aid 620 and a second received combined vector corresponding to the second hearing aid 630, based on audio signals through a first wireless channel between the external wireless device 610 and the first hearing aid 620 and audio signals through a second wireless channel between the external wireless device 610 and the second hearing aid 630. The method also performs signal processing using the first received combined vector and the second received combined vector.

When the second communication mode is selected as the target communication mode, the method determines the beam forming vector to form a beam directed towards a rear of the head of the user wearing the first hearing aid 620 and the second hearing aid 630. The method also determines the received combined vector. The method may further perform signal processing using the beam forming vector or the received combined vector.

In one example, the method at the second communication mode, which is a binaural wireless communication method, measures a wireless channel between the first antenna 621 mounted to the first hearing aid 620 and the second antenna 631 mounted to the second hearing aid 630 and determines the beam forming vector and the received combined vector based on the wireless channel.

Figure 9:
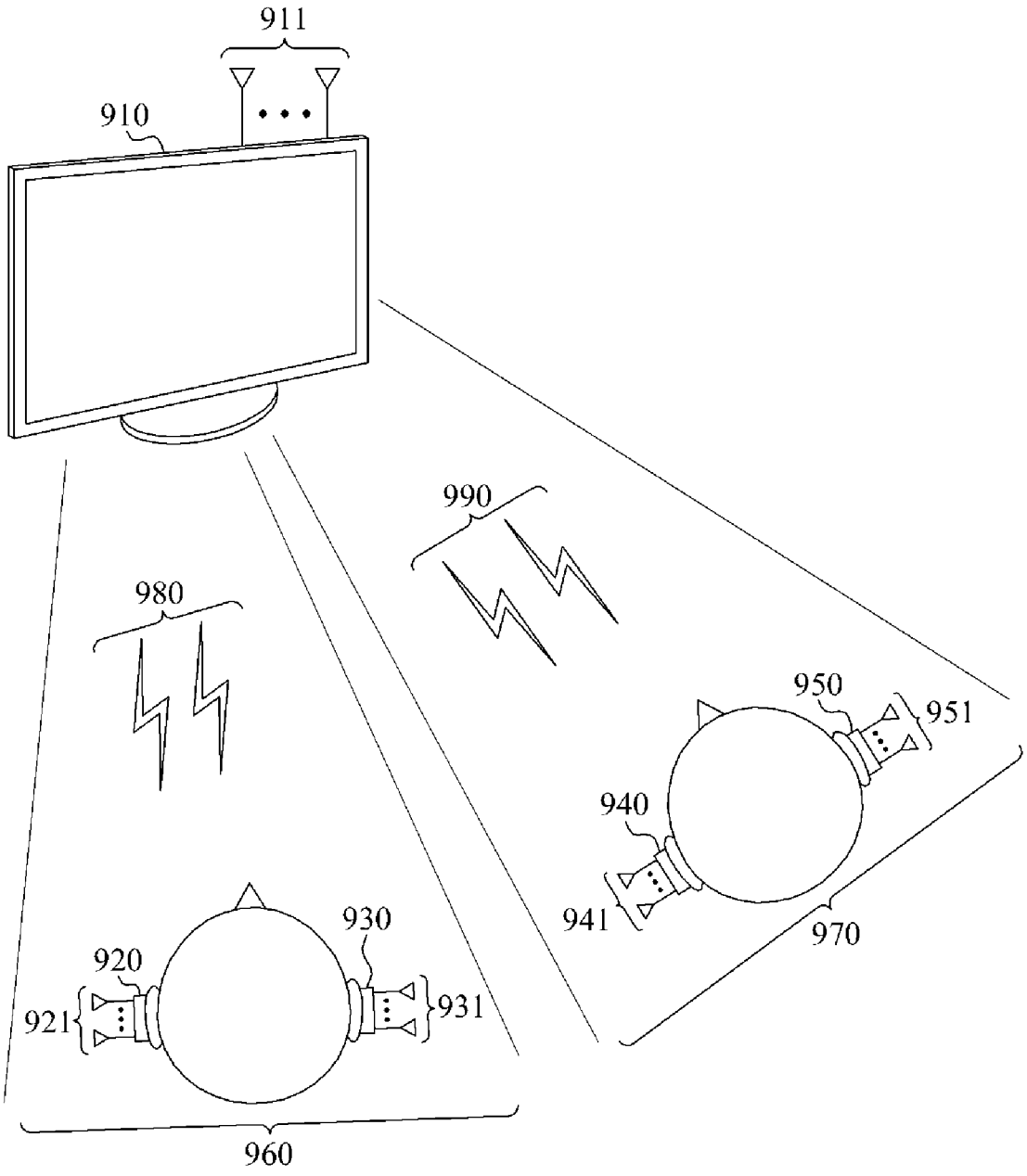
FIG. 9 is a diagram illustrating an example of a communication between an audio source performing spatial multiplexing and a hearing device, in accordance with an embodiment.

FIG. 9 illustrates an example of a communication between an audio source performing spatial multiplexing and a hearing device, in accordance with an embodiment.

Referring to FIG. 9, an audio source 910 includes multiple antennas 911. Although multiple antennas are illustrated, the configuration of FIG. 9 may include one antenna 911. FIG. 9 also illustrates a first hearing aid 920 of a first user and a second hearing aid 930 of the first user, and a first hearing aid 940 of a second user and a second hearing aid 950 of the second user. Here, the audio source 910 may be an external wireless device including, but not limited to, a high definition television (HDTV), an optical disc player, a setup box, a cellular device, a personal digital assistant (PDA), a digital camera, a portable game console, and an MP3 player, a portable/personal multimedia player (PMP), a handheld e-book, a portable lab-top PC, a global positioning system (GPS) navigation, and devices such as a desktop PC, and the like capable of wireless communication or network communication consistent with that disclosed herein. The hearing aids 920, 930, 940, and 950 may include at least one or multiple antennas 921, 931, 941, and 951, respectively.

A first audio signal 980 and a second audio signal 990 spatially multiplexed by the audio source 910 include a first spatial domain 960 and a second spatial domain 970, respectively. The first hearing aid 920 and the second hearing aid 930 of the first user detect the first audio signal 980 from the spatial domains 960 and 970 using the multiple antennas 921 and 931, respectively. Also, the first hearing aid 920 and the second hearing aid 930 of the first user select the first spatial domain 960, which is a necessary spatial domain of the audio source 910 corresponding to the first user.

In the same manner, the first hearing aid 940 and the second hearing aid 950 of the second user detect the second audio signal 990 from the spatial domains 960 and 970 using the multiple antennas 941 and 951, respectively. Also, the first hearing aid 940 and the second hearing aid 950 of the second user select the second spatial domain 970, which is a spatial domain of the audio source 910 corresponding to the second user.

For example, the audio source 910 may be a dual-view TV. The dual-view TV may include the multiple antennas 911. The first user using the first hearing aid 920 and the second hearing aid 930 may receive the first audio signal 980 in the first spatial domain 960. The second user using the first hearing aid 940 and the second hearing aid 950 may receive the second audio signal 990 in the second spatial domain 970.

As another example, when an external wireless device exists in addition to the audio source 910, the first hearing aid 920 and the second hearing aid 930 of the first user may selectively receive additional audio signals from the external wireless device using a wireless channel that is the same as a wireless channel from the audio source 910. However, the additional audio signals would not distort the first audio signal 980.

Also, the first hearing aid 940 of the second user and the second hearing aid 950 of the first user may selectively receive additional audio signals from the external wireless device using a wireless channel that is the same as the wireless channel from the audio source 910. However, the additional audio signals would not distort the second audio signal 990.

Figure 10:
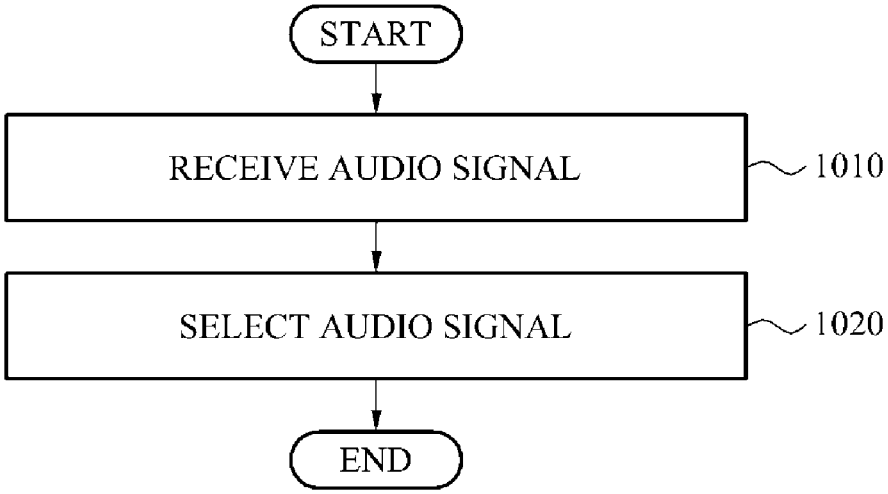
FIG. 10 is a diagram illustrating an example of a communication method between the audio source performing spatial multiplexing and the hearing device, in accordance with an embodiment.

FIG. 10 is a diagram illustrating an example of a communication method between the audio source performing spatial multiplexing and the hearing device, in accordance with an embodiment.

Referring to FIG. 10, at operation 1010, the method of the hearing device receives at least two audio signals spatially multiplexed 980 and 990 by the audio source 910.

At operation 1020, the method of the hearing device selects any one of the at least two spatially-multiplexed audio signals 980 and 990. In one illustrative example, the selecting refers to exclusion of remaining audio signals except audio signals to be extracted by the hearing device.

The processor and the communication module described herein may be implemented using hardware components. For example, a processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such as parallel processors.

The processor and the communication module may include a computer program, a piece of code, an instruction, or some combination thereof, for independently or collectively instructing or configuring the processing device to operate as desired. Software and data may be embodied permanently or temporarily in the processor and the communication module, a component thereof, physical or virtual equipment, non-transitory computer storage medium or device, or in a propagated signal wave capable of providing instructions or data to or being interpreted by the processor and the communication module. The software also may be distributed over network coupled computer systems so that the software is stored and executed in a distributed fashion. In particular, the software and data may be stored by one or more non-transitory computer readable recording mediums.

The above-described embodiments may be recorded, stored, or fixed in one or more non-transitory computer-readable media that includes program instructions to be implemented by a computer to cause a processor to execute or perform the program instructions. The media may also include, alone or in combination with the program instructions, data files, data structures, and the like. The program instructions recorded on the media may be those specially designed and constructed, or they may be of the kind well-known and available to those having skill in the computer software arts. Examples of non-transitory computer-readable media include magnetic media such as hard disks, floppy disks, and magnetic tape; optical media such as CD ROM disks and DVDs; magneto-optical media such as optical discs; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations and methods described above, or vice versa.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A method of a hearing device, the method comprising:

extracting an audio signal through a first hearing aid;

determining a beam forming vector as a beam toward a rear of a head of a user wearing the first hearing aid and a second hearing aid;

pre-coding of the audio signal using the beam forming vector; and transmitting the pre-coded audio signal to the second hearing aid, measuring the audio signal through a wireless channel between a first antenna mounted on the first hearing aid and a second antenna mounted on the second hearing aid, wherein the determining of the beam forming vector comprises determining the beam forming vector based on the measured audio signal through the wireless channel.

2. The method of claim 1, wherein the first hearing aid comprises the first multiple antenna and the second hearing aid comprises a second multiple antenna.

3. The method of claim 2, further comprising:

determining a direction of the beam forming vector from the audio signal through the wireless channel measured between the first antenna mounted at the first hearing aid and the second antenna mounted to the second hearing aid.

4. The method of claim 1, wherein the determining of the beam forming vector comprises:

selecting a preset beam forming vector as a fixed value.

5. The method of claim 1, further comprising:

receiving the pre-coded audio signal through the second antenna;

performing combining of the pre-coded audio signal at the second hearing aid; and extracting a desired audio signal from a result of the combining.

6. The method of claim 5, wherein the performing of the combining of the pre-coded audio signal comprises:

determining a received combined vector based on the wireless channel.

7. The method of claim 1, further comprising:

receiving at least two audio signals spatially multiplexed by an audio source; and selecting one of the at least two spatial-multiplexed audio signals.

8. The method of claim 1, further comprising:

selecting the first hearing aid as a transmitting hearing aid and selecting the second hearing aid as a receiving hearing aid based on a preset setting.

9. The method of claim 1, further comprising:

controlling a physical direction of the first antenna or the second antenna.

10. The method of claim 2, further comprising:

measuring in real time the audio signals through the wireless channel between the first antenna of the first hearing aid and the second antenna of the second hearing aid.

11. A hearing device, comprising:

a communication module configured to determine a beam forming vector to form a beam toward a rear of a user wearing a first hearing aid and a second hearing aid and to pre-code the audio signal using the beam forming vector; and a first antenna of the first hearing aid configured to transmit the pre-coded audio signal to the second hearing aid, wherein the determining of the beam forming vector comprises determining the beam forming vector based on the measured audio signal through the wireless channel, wherein the second hearing aid comprises:

a second antenna configured to receive the pre-coded audio signal from the first hearing aid;

a second communication module configured to determine a received combined vector based on an audio signal through a wireless channel and perform combining of the pre-coded audio signal using the received combined vector;

a second processor configured to process the combined audio signal; and a speaker configured to output the processed audio signal.

12. The hearing device of claim 11, wherein the first hearing aid further comprises:

a processor configured to process the pre-coded audio signal; and a speaker configured to output the processed audio signal.

13. The hearing device of claim 11, wherein the first antenna comprises multiple first antennas and the second antenna comprises multiple second antennas.

* * * * *